US006267582B1

(12) United States Patent
Lin

(10) Patent No.: US 6,267,582 B1
(45) Date of Patent: Jul. 31, 2001

(54) POCKET LIGHTER

(76) Inventor: Guang Lin, 109 Kings Mountain Dr., Greer, SC (US) 29650

( * ) Notice: Subject to any disclaimer, the term of this patent is extended or adjusted under 35 U.S.C. 154(b) by 0 days.

(21) Appl. No.: 09/439,523

(22) Filed: Nov. 12, 1999

(51) Int. Cl.[7] ..... F23Q 2/28
(52) U.S. Cl. ..... 431/153; 431/255
(58) Field of Search ..... 431/153, 132, 431/255, 144, 152

(56) References Cited

U.S. PATENT DOCUMENTS 3,540,823 * 11/1970 Ebine et al. ..... 431/132
4,089,636 * 5/1978 Goto ..... 431/132
4,442,945 * 4/1984 Sandhaus ..... 215/216
5,713,733 2/1998 Ming .
5,854,530 * 12/1998 LaForest et al. ..... 431/255
5,971,751 * 10/1999 Lee ..... 431/153
6,077,071 * 6/2000 Yeh ..... 431/153

* cited by examiner

*Primary Examiner*—Sara Clarke
(74) *Attorney, Agent, or Firm*—Nelson Mullins Riley & Scarborough

(57) ABSTRACT

A pocket lighter of the present invention comprises a gas container having an outlet valve through which ignitable gas is released. An igniter device having a reciprocative plunger is also provided. The igniter device is operative to produce a spark when the plunger is axially moved. A thumb actuator is operative to cause opening of the outlet valve and axial movement of the reciprocative plunger, thereby producing a controlled flame. The pocket lighter is constructed and arranged such that at least ten pounds of force is required to operate the thumb actuator.

15 Claims, 8 Drawing Sheets

POCKET LIGHTER

BACKGROUND OF THE INVENTION

The present invention relates generally to the art of pocket lighters, often referred to as "cigarette lighters." More particularly, the invention relates to an improved pocket lighter which is adapted to enhance its child resistance characteristics.

The domestic standards for child resistance of pocket lighters are set forth at 16 C.F.R., Part 1210. New lighters proposed for sale must be shown to satisfy the child resistance standards before the lighters can be sold in the United States. Manufacturers of pocket lighters have employed various techniques in an effort to comply with the child resistance standards.

In this regard, some lighters utilize a mechanism preventing the lighter's thumb button from being depressed unless a preliminary step is first taken. For example, it may be necessary to move a slider mechanism to a predetermined position before the thumb button can be depressed. While such techniques have worked generally well, there is a need in the art for additional novel constructions of pocket lighters.

SUMMARY OF THE INVENTION

A pocket lighter in accordance with one aspect of the present invention comprises a gas container having an outlet valve through which ignitable gas is released. An igniter device having a reciprocative plunger is also provided. The igniter device is operative to produce a spark when the plunger is axially moved. A thumb actuator is operative to cause opening of the outlet valve and axial movement of the reciprocative plunger, thereby producing a controlled flame. The pocket lighter is constructed and arranged such that at least ten pounds of force is required to operate the thumb actuator.

In some exemplary embodiments, a valve spring is situated so as to operate against opening of the outlet valve. The valve spring thus contributes to the force required to operate the thumb actuator. Often, the pocket lighter will comprise an outlet tube in fluid communication with the outlet valve. In such cases, the valve spring may comprise a helical spring located about the outlet tube.

The pocket lighter may be constructed so that the outlet valve is opened via a pivotal lever engaged by the actuator button. In some exemplary embodiments, a fulcrum location of the pivotal lever will be located approximately 2.0 millimeters from an axis of the outlet valve. Preferably, the lever and outlet valve will contribute at least about two pounds of force to the force required to operate the thumb actuator.

In some exemplary embodiments, at least one actuator spring contributes to the force required to operate the thumb actuator. Preferably, the actuator spring will be operative to contribute at least about five pounds of force to the force required to operate the thumb actuator. Depending on the exigencies of a particular application, the actuator spring may take on a variety of different configurations. For example, a pair of coaxial helical springs may be used for this purpose. In some cases, the actuator spring may be located beside the igniter device. Alternatively, the actuator spring may be located beneath a bottom surface of the igniter device.

The pocket lighter may comprise an outer housing having a housing end cap configured to be fit therein. In some such embodiments, an actuator spring located between the housing end cap and the thumb actuator may provide a predetermined force for operation of the thumb actuator.

In another aspect, the pocket lighter comprises an outer housing having an open end. A housing end cap is configured to be fit into the open end of the outer housing. A gas container, having an outlet valve through which ignitable gas is released, is located in the housing. An igniter device is also located in the housing, having a reciprocative plunger operative to produce a spark when axially moved. A thumb actuator is located at the housing end cap and moveable with respect thereto. The thumb actuator is operative to cause opening of the outlet valve and axial movement of the reciprocative plunger to thereby produce a controlled flame. An actuator spring is located between the housing end cap and the thumb actuator to provide a predetermined force for operation of the thumb actuator.

In some exemplary embodiments, the actuator spring is a helical spring. For example, a helical spring may be located about a shaft of the thumb actuator. In this regard, the thumb actuator may be configured having a button portion located at one end of the shaft. The helical spring in such embodiments will typically engage a bottom surface of the button portion.

A still further aspect of the present invention is achieved by a pocket lighter comprising an outer housing having an open end. A housing end cap is configured to be fit into the open end of the outer housing. A gas container located in the housing has an outlet valve through which ignitable gas is released. An igniter device, also located in the housing, has a reciprocative plunger operative to produce a spark when axially moved. A thumb actuator is located at the housing end cap and moveable with respect thereto. The thumb actuator is operative to cause opening of the outlet valve and axial movement of the reciprocative plunger to thereby produce a controlled flame. The pocket lighter further comprises a pivotal lever extending between the outlet valve and the thumb actuator. The pocket lighter is constructed and arranged such that at least ten pounds of force are required to operate the thumb actuator.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
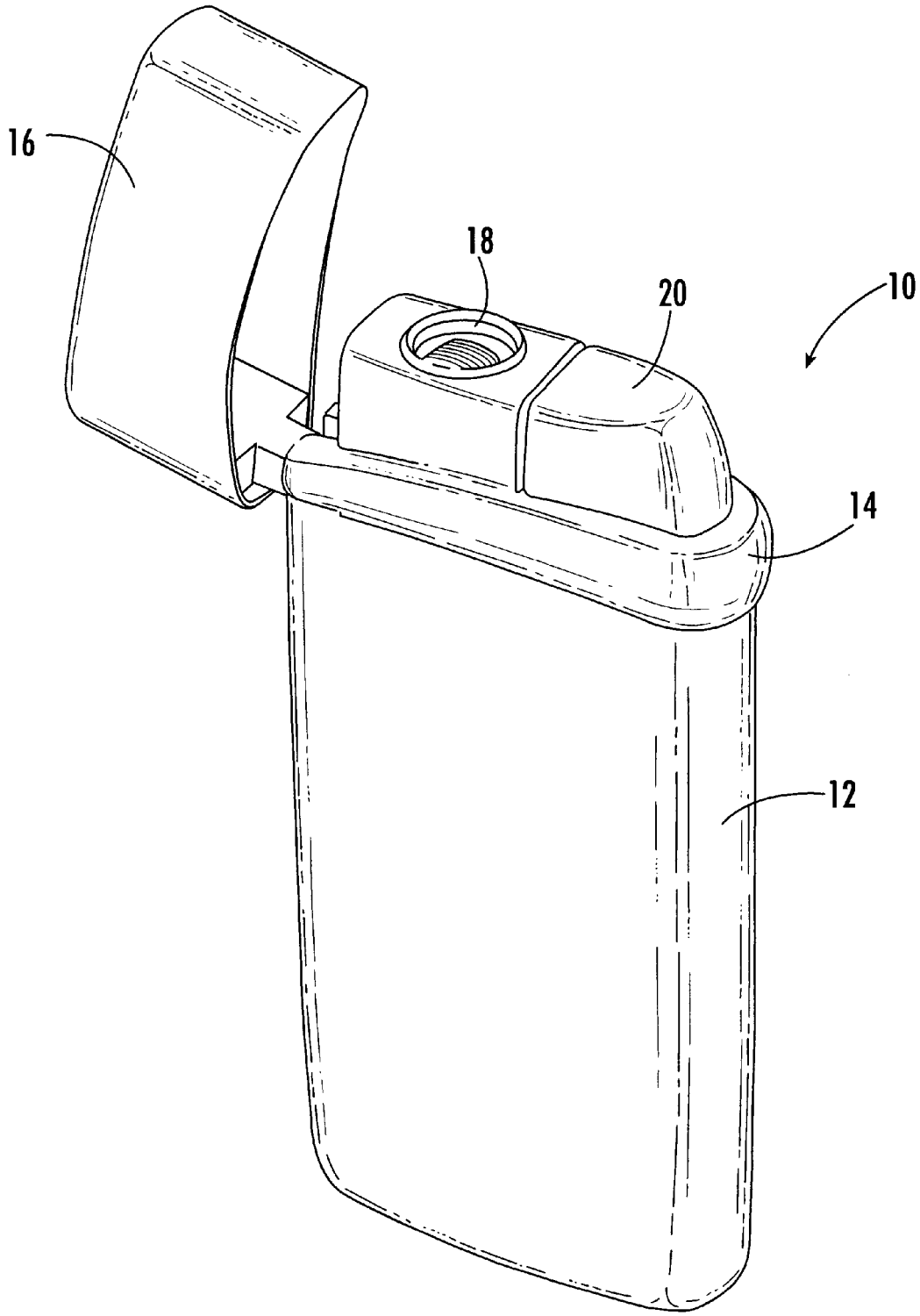
FIG. 1. (PRIOR ART)
FIG. 1 is a perspective view showing the external appearance of a pocket lighter that may be improved according to the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

FIG. 1 illustrates a typical pocket lighter 10 that may be improved according to the present invention. The exterior of pocket lighter 10 is formed by an outer housing 12 having an open end into which an end cap 14 is fit. A head cover 16 is pivotally attached to end cap 14, as shown.

As can be seen, lighter 10 includes a flame port 18. A thumb actuator, here in the form of thumb button 20, is carried by the housing end cap. Depression of thumb button 20 will cause a controlled flame to be produced at flame port 18. Preferably, the flame will cease when the user releases thumb button 20.

Figure 2:
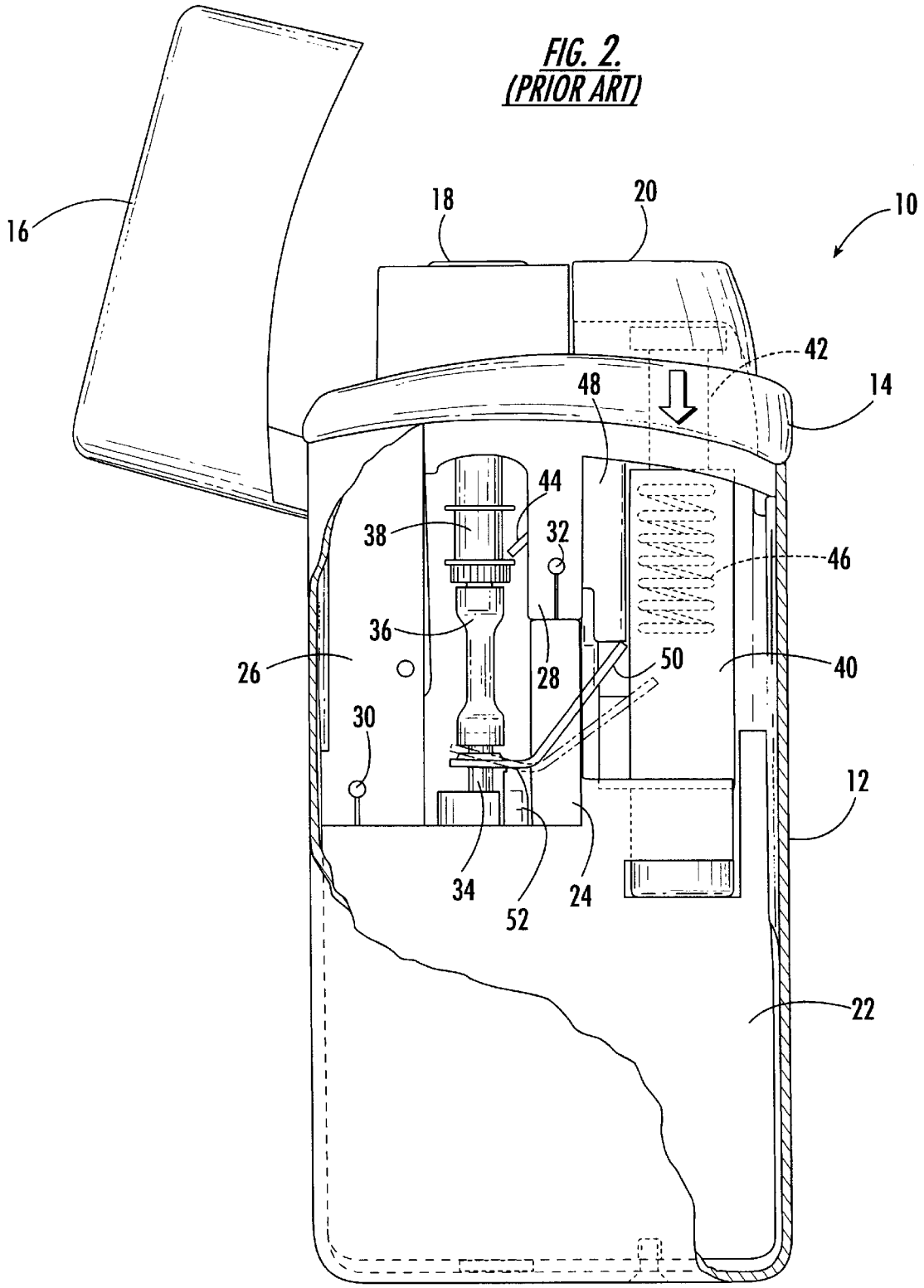
FIG. 2. (PRIOR ART)
FIG. 2 is a cutaway view showing internal components of a pocket lighter in accordance with the prior art.

The internal construction of lighter 10 may be most easily explained with reference to FIG. 2. As shown, a gas container 22 is located in the bottom portion of outer housing 12. Gas container 22 is adapted to contain a predetermined quantity of a suitable ignitable gas, such as butane. Gas container 22 may be refilled by butane received through an orifice (not shown) defined in the bottom of outer housing 12.

Preferably, gas container 22 is made of a rigid plastic material which is configured having various features in addition to the gas reservoir. For example, gas container 22 preferably includes upstanding posts, such as post 24, for connection to depending posts 26 and 28 of end cap 14. Through-pins 30 and 32 are provided to innerconnect the upstanding posts of gas container 22 with the depending posts of end cap 14.

Gas container 22 includes an outlet valve 34 through which ignitable gas is selectively released. An outlet tube provides fluid communication between valve 34 and flame port 18. As shown, the outlet tube has a flexible tube portion 36 and a rigid tube portion 38.

Lighter 10 further includes an igniter device 40 seated into a configured receptable defined in the top surface of gas container 22. Igniter device 40 does not include a sparking flint wheel, but operates to create a spark via an electronic catalyst that is activated by the depression of a reciprocative plunger 42. Igniter device 40 includes an electrode 44 in close proximity to tube portion 38. Thus, movement of plunger 42 in the downward direction (as indicated by the arrow) causes a spark to be produced at electrode 44.

Plunger 42 is moved in the downward axial direction when a user depresses thumb button 20. As can be seen, igniter device 40 has an internal spring 46 which urges plunger 42 into a normally upward position.

As shown, thumb button 20 includes an extension 48 engaging one end of a lever 50. Lever 50 pivots on a fulcrum 52 (formed integrally with gas container 22) to move valve 34 in an upward axial direction. When valve 34 is moved in this manner, it is opened so that gas will be released from container 22. Flexible tube portion 36 allows the outer tube to deform slightly to accommodate the axial movement of valve 34.

It can be seen that depression of thumb button 20 will cause two events to take place. One, valve 34 will be opened, thus releasing ignitable gas from container 22. Two, a spark will be generated at electrode 44 of igniter device 40. As a result, a controlled flame will be produced at flame port 18, as desired. The flame will cease when thumb button 20 is released.

It will be appreciated that the majority of the force required to depress thumb button 20 is contributed by the spring constant of spring 46. In other words, most of the force necessary to depress thumb button 20 is force required to overcome spring 46. Generally, lighters of this type have been constructed so that about 4–5 pounds of force will be necessary to produce a flame.

In accordance with the present invention, it has been found that the child resistance characteristics of a pocket lighter can be enhanced if at least ten pounds of force are required to depress the thumb button. This greater force may be achieved by substituting a larger spring for spring 46. It is often undesirable, however, to utilize a larger spring in this location, since it may have a tendency to shorten the operational life of the igniter.

Thus, FIGS. 3–4 and 6–9 illustrate various techniques which may be utilized to augment the force provided by the spring located within the igniter device. These techniques may be utilized singly or in combination until a desired force level is achieved. Within each embodiment, conventional elements which are also present in pocket lighter 10 will be indicated by the same reference number. However, the overall embodiment and unique aspects of each embodiment will be indicated by a reference number augmented by 100 in relation to a previous embodiment.

Figure 3:
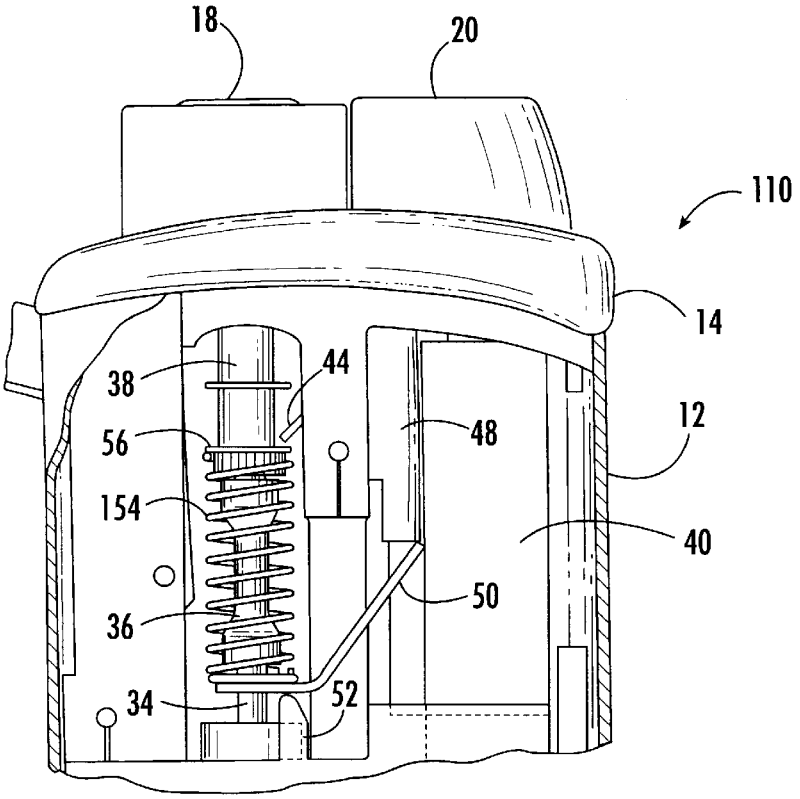
FIG. 3 is a cutaway view showing internal components of a pocket lighter in accordance with one aspect of the present invention.

Thus, FIG. 3 illustrates a pocket lighter 110 made in accordance with one aspect of the present invention. In this embodiment, a valve spring 154 is situated to operate against opening of outlet valve 34. Valve spring 154 is constructed as a helical spring in this case, situated about flexible tube portion 36. When valve 34 is opened, spring 154 compresses between the upper surface of lever 50 and a retaining flange 56 fixed to rigid tube portion 38. Spring 154 is sized to achieve the desired level of overall force necessary to depress thumb button 20.

Figure 4:
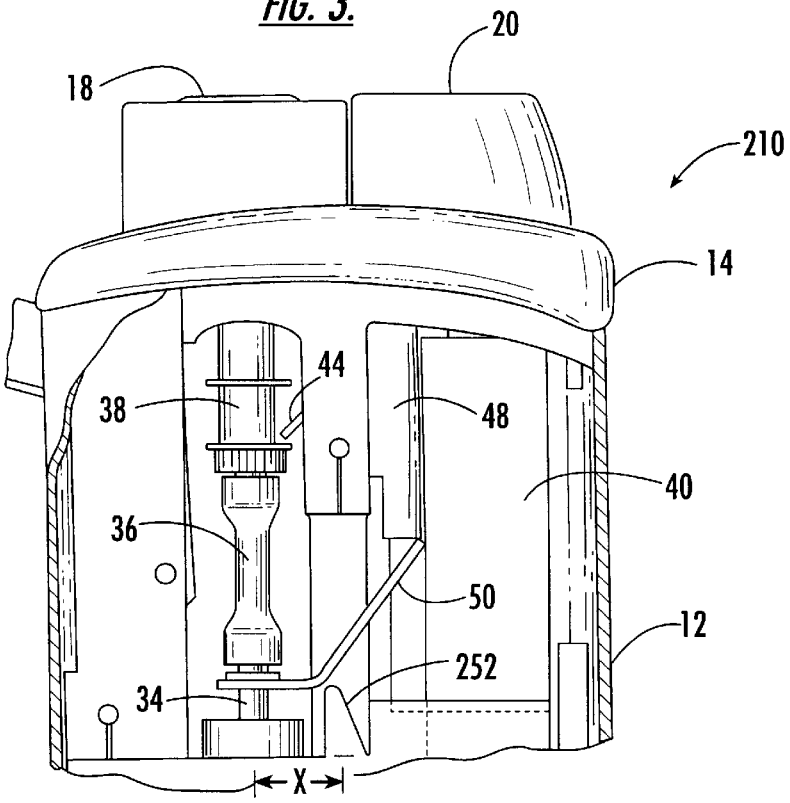
FIG. 4 is a cutaway view showing internal components of a pocket lighter in accordance with another aspect of the present invention.

Another technique that may be utilized to increase the depression force at thumb button 20 is illustrated in FIG. 4. Specifically, FIG. 4 shows a pocket lighter 210 in which the moment of lever 50 has been altered to achieve a greater depression force. As shown in lighter 10 of the prior art, fulcrum 52 is normally placed just under the outlet tube. In this case, however, fulcrum 252 is moved away from the center axis of outlet valve 34 by a distance X. Preferably, the distance X will be at least approximately 2 mm. When fulcrum 252 is placed in this location, lever 50 and outlet valve 34 will contribute at least about two pounds to the overall depression force.

Figure 5:
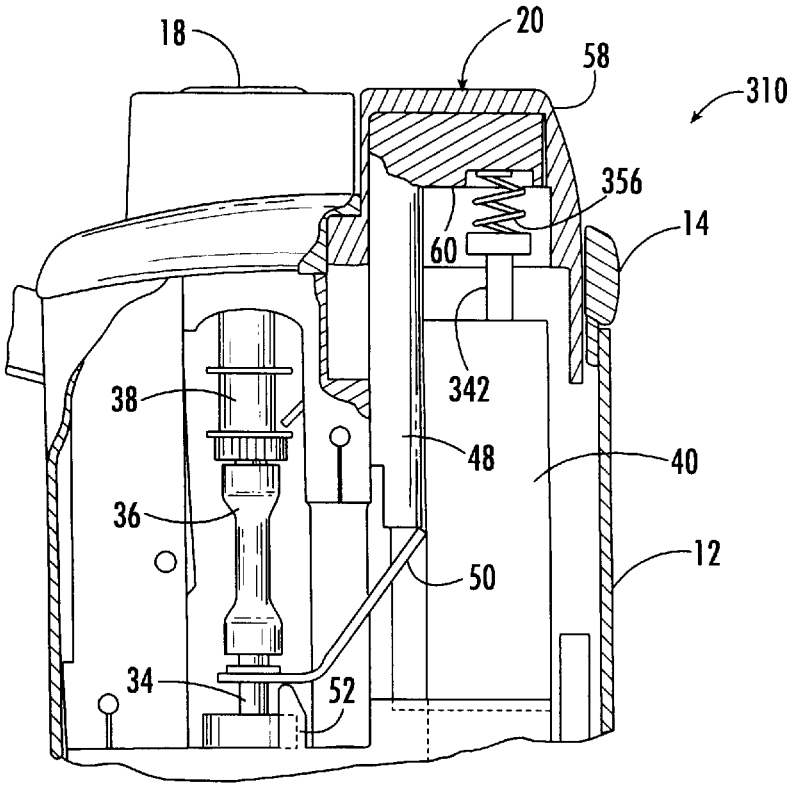
FIG. 5. (PRIOR ART)
FIG. 5 is a cutaway view showing internal components of a pocket lighter in accordance with the prior art.

Before proceeding to discuss additional embodiments of the present invention, it is helpful to explain one further aspect of the prior art. In this regard, FIG. 5 illustrates a pocket lighter 310 of the prior art having a relatively small actuator spring 356. As shown, spring 356 extends between a recess defined in the bottom of thumb button 20 and the top surface of plunger 342. This figure also illustrates one manner in which thumb button 20 may be constructed. Specifically, thumb button 20 includes a metal outer portion 58 having a plastic insert 60 situated therein.

Figure 6:
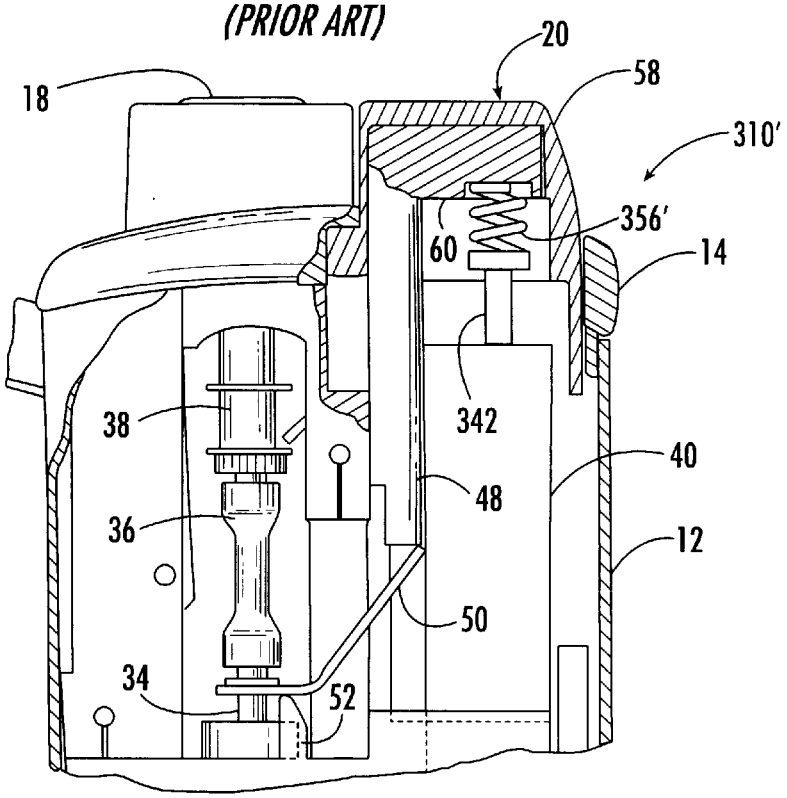
FIG. 6 is a view similar to FIG. 5 showing one manner in which the pocket lighter thereof may be improved according with the present invention.

FIG. 6 illustrates an improved pocket lighter 310' constructed in accordance with the invention. In this case, the relatively small spring 356 of lighter 310 has been replaced by a "bigger" spring 356'. The spring constant of spring 356' is chosen to produce the desired level of actuation force for thumb button 20. For example, spring 356' may contribute at least five pounds to the overall depression force in many exemplary embodiments.

Figure 7:
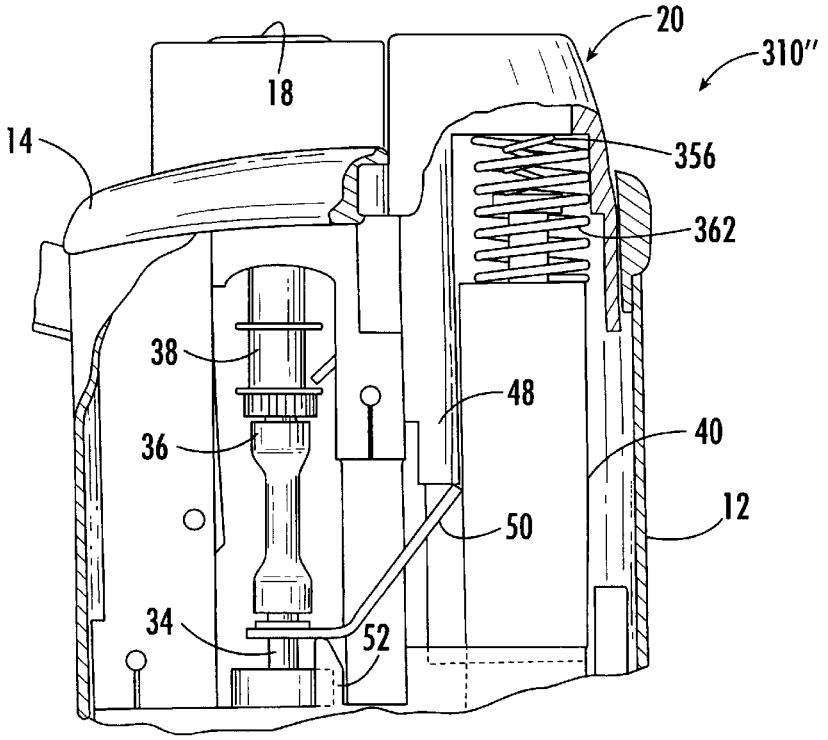
FIG. 7 is a cutaway view showing internal components of a pocket lighter in accordance with a still further aspect of the present invention.

FIG. 7 illustrates an alternative technique for providing a higher level of spring force for actuation of thumb button 20. In this case, a pocket lighter 310" is provided having a pair of coaxial helical springs which must be overcome when thumb button 20 is depressed. Spring 356 may be the same as in the prior art of FIG. 5. An outer spring 362 provides the additional spring force desired to enhance the child-resistance characteristics of the lighter.

Figure 8:
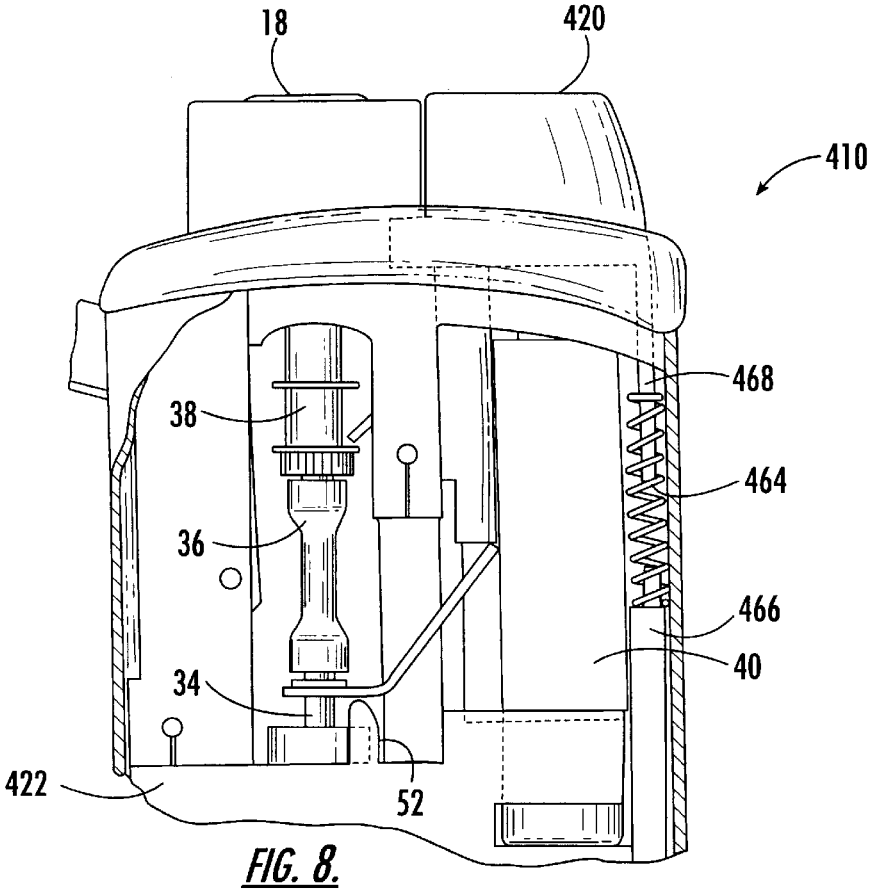
FIG. 8 is a cutaway view showing internal components of a pocket lighter in accordance with an additional aspect of the present invention.

A still further alternative technique by which the actuation force of the lighter may be increased is shown in FIG. 8. Specifically, FIG. 8 illustrates a pocket lighter 410 having an actuator spring 464 located beside igniter device 40. In this embodiment, gas container 422 is configured to provide an integral seat 466 against which one end of spring 464 will rest. The opposite end of spring 464 is engaged by an extension portion 468 formed integral with thumb button 420.

Figure 9:
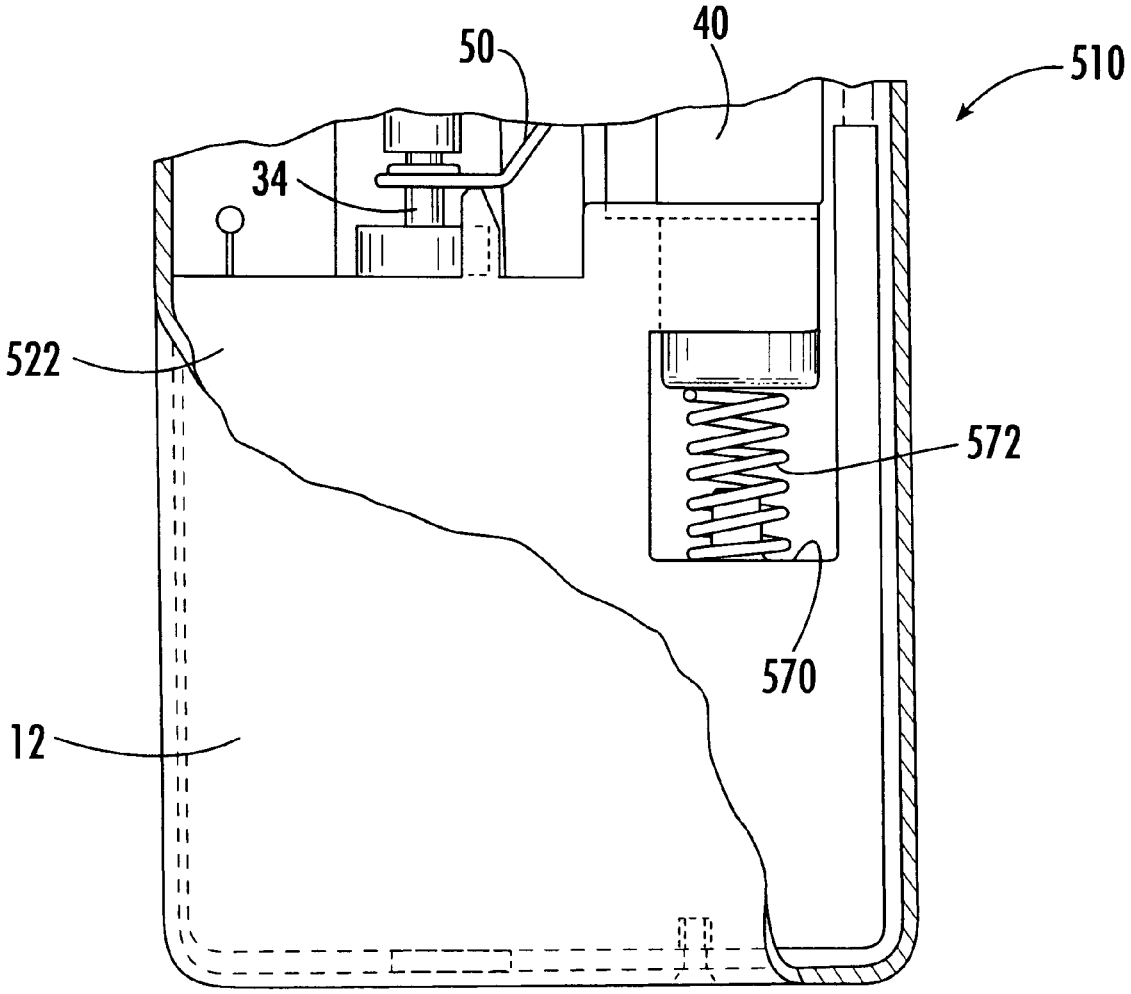
FIG. 9 is a cutaway view showing internal components of a pocket lighter in accordance with another aspect of the present invention.

FIG. 9 illustrates a pocket lighter 510 constructed in accordance with an additional aspect of the invention. In this case, gas container 522 is configured to define a deepened receptacle 570 in which igniter device 40 is seated. The depth of receptacle 570 permits an actuator spring 572 to be situated beneath igniter device 40. Spring 572 thus contributes to the overall force required to depress the thumb button.

Figure 10:
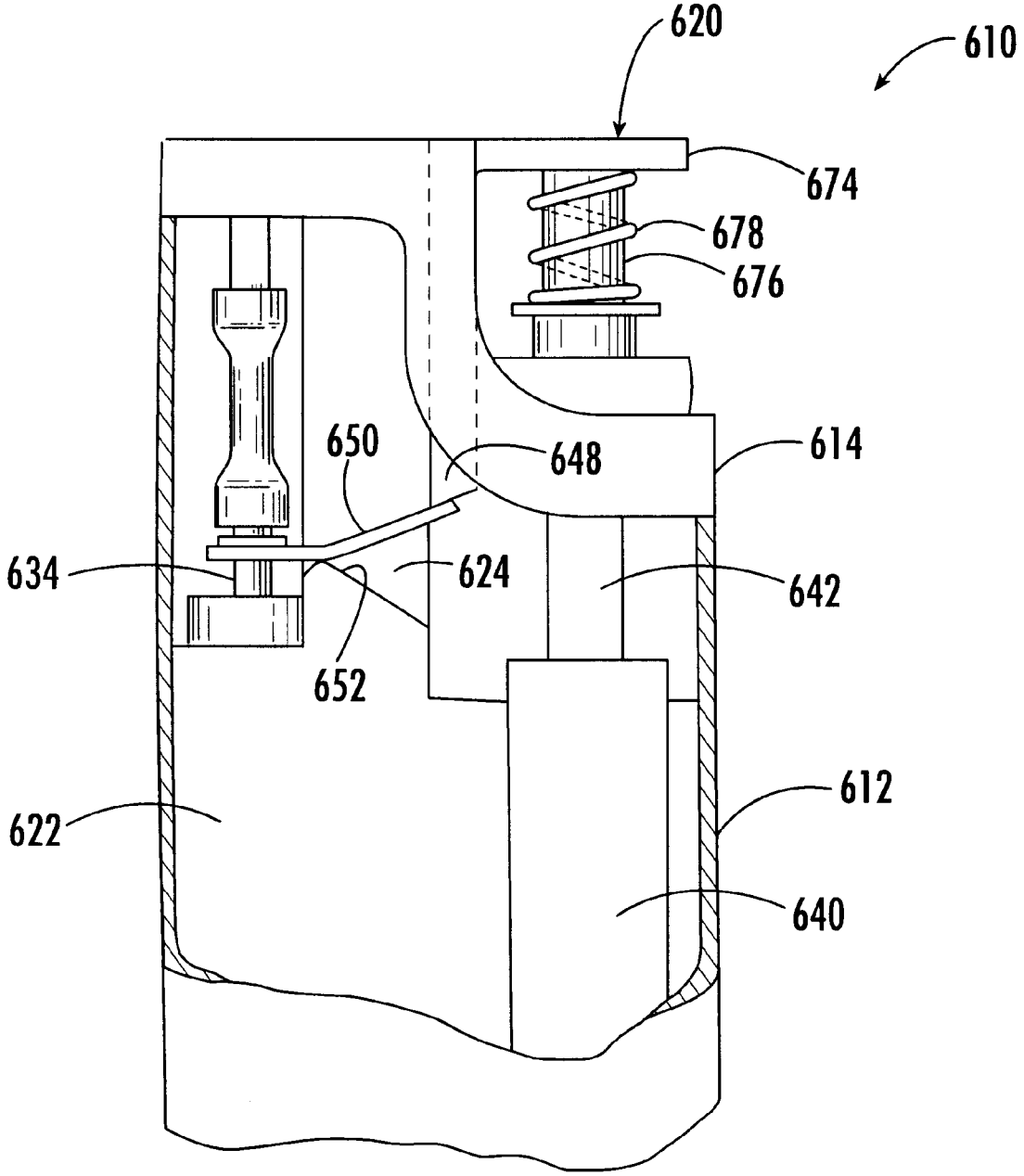
FIG. 10 is a cutaway view showing internal components of a pocket lighter in accordance with a still further aspect of the present invention.
Figure 11:
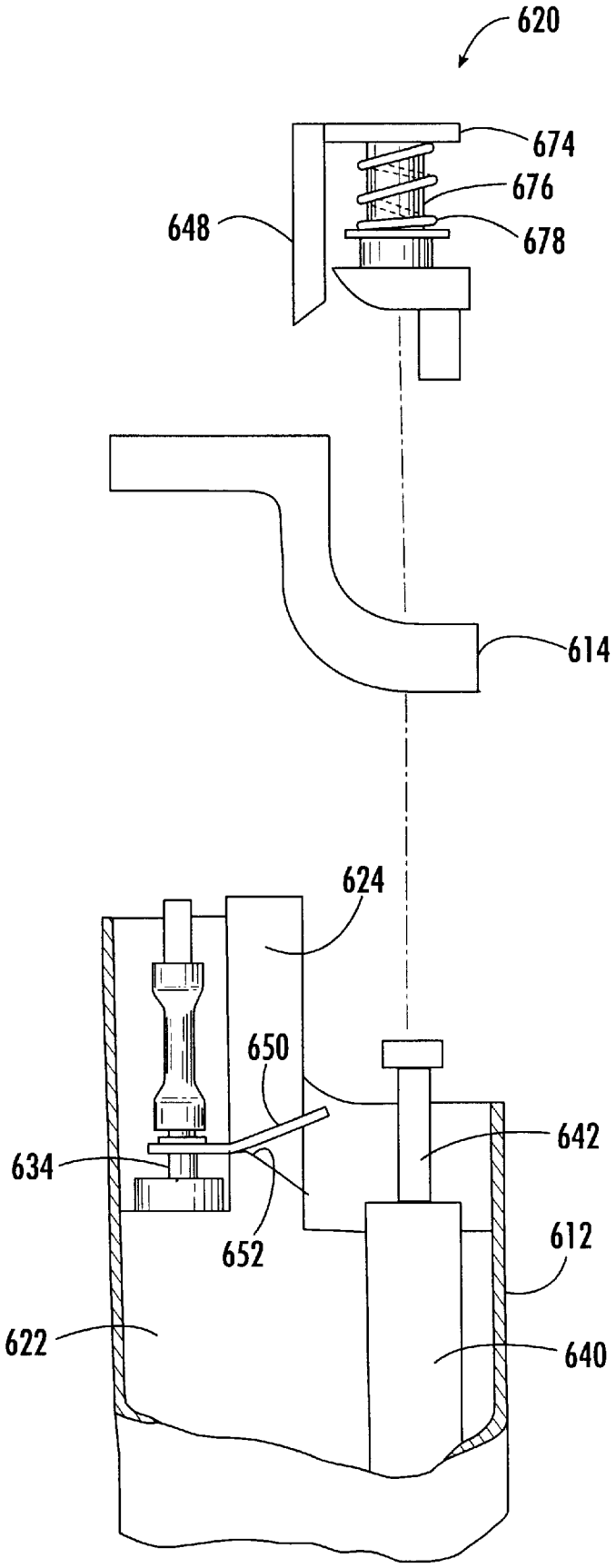
FIG. 11 is a view of the pocket lighter of FIG. 10 with certain parts separated for purposes of explanation.

FIGS. 10 and 11 illustrate a pocket lighter 610 constructed in accordance with a further aspect of the present invention. As shown, lighter 610 includes an outer housing 612 having an end cap 614 fitted into one end thereof. A gas container 622 is located inside of housing 612, as shown. Gas container 622 defines a receptacle in which an igniter device 640 is seated. Igniter device 640 includes a reciprocative plunger 642 which is moved axially when thumb button 620 is depressed.

An upstanding post 624 extends upwardly from the main portion of gas container 622, as shown. A fulcrum 652 is located adjacent to post 624 to provide a surface about which lever 650 can pivot. Lever 650 functions to open outer valve 634 in a manner similar to that described above.

In this case, thumb button 620 is configured having a button portion 674 located at one end of a movable shaft 676. An extension 648 integrally depends from thumb portion 674 to engage one end of lever 650.

An actuator spring 678 is located about shaft 676, as shown. One end of actuator spring 678 engages the bottom surface of button portion 674. The other end of actuator spring 678 engages a surface fixed with respect to end cap 614. Thus, spring 678 contributes to the force that must be overcome in order to ignite the gas released from container 622.

It can be seen that the present invention provides various novel constructions for a pocket lighter in accordance with the objects set forth above. While preferred embodiments of the invention have been shown and described, modifications and variations may be made thereto by those of ordinary skill in the art without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A pocket lighter comprising:

a gas container having an outlet valve through which ignitable gas is released;

an igniter device having a reciprocative plunger which operates against a first predetermined force of an internal spring, said igniter device being operative to produce a spark when said plunger is axially moved;

a thumb actuator operative to cause opening of said outlet valve and axial movement of said reciprocative plunger to thereby produce a controlled flame;

at least one actuator spring contributing a second predetermined force of at least about five pounds to a total force required to operate said thumb actuator; and whereby said pocket lighter is constructed and arranged such that said total force required to operate said thumb actuator is child resistant, but only a force exceeding said first predetermined force is necessary to cause ignition of said igniter device.

2. A pocket lighter as set forth in claim 1, wherein a valve spring is situated so as to operate against opening of said outlet valve, said valve spring contributing to the force required to operate said thumb actuator.

3. A pocket lighter as set forth in claim 2, wherein said pocket lighter comprises an outlet tube in fluid communication with said outlet valve and said valve spring comprises a helical spring located about said outlet tube.

4. A pocket lighter as set forth in claim 1, wherein said outlet valve is opened via a pivotal lever engaged by said thumb actuator.

5. A pocket lighter as set forth in claim 4, wherein a fulcrum location of said pivotal lever is located approximately 2.0 millimeters from an axis of said outlet valve.

6. A pocket lighter as set forth in claim 4, wherein said lever and said outlet valve contribute at least about two pounds of force to the force required to operate said thumb actuator.

7. A pocket lighter as set forth in claim 1, wherein said at least one actuator spring comprises a pair of coaxial helical springs.

8. A pocket lighter as set forth in claim 1, wherein said actuator spring is located beside said igniter device.

9. A pocket lighter as set forth in claim 1, wherein said actuator spring is located beneath a bottom surface of said igniter device.

10. A pocket lighter as set forth in claim 1, comprising an outer housing having a housing end cap configured to be fit therein.

11. A pocket lighter as set forth in claim 10, comprising an actuator spring located between said housing end cap and said thumb actuator to provide a predetermined force for operation of said thumb actuator.

12. A pocket lighter comprising:

an outer housing having an open end;

a housing end cap configured to be fit into said open end of said outer housing;

a gas container located in said housing, said gas container having an outlet valve through which ignitable gas is released;

an igniter device located in said housing, said igniter device having a reciprocative plunger operative against a first predetermined force of an internal spring to produce a spark when axially moved;

a thumb actuator located at said housing endcap and movable with respect thereto, said thumb actuator operative to cause opening of said outlet valve and axial movement of said reciprocative plunger to thereby produce a controlled flame;

at least one actuator spring contributing a second predetermined force of at least about five pounds to a total force required to operate said thumb actuator;

a pivotal lever extending between said outlet valve and said thumb actuator; and whereby said pocket lighter is constructed and arranged such that said total force required to operate said thumb actuator is at least ten pounds, but only a force exceeding said first predetermined force is necessary to cause ignition of said igniter device.

13. A pocket lighter as set forth in claim 12, wherein a fulcrum location of said pivotal lever is located approximately 2.0 millimeters from an axis of said outlet valve.

14. A pocket lighter as set forth in claim 13, wherein said lever and said outlet valve contribute at least about two pounds of force to the force required to operate said thumb actuator.

15. A pocket lighter as set forth in claim 12, further comprising a head cover pivotally connected to said housing end cap.

* * * * *

US006267582C1

(12) EX PARTE REEXAMINATION CERTIFICATE (5848th)

United States Patent
Lin

(10) Number: US 6,267,582 C1
(45) Certificate Issued: Aug. 7, 2007

(54) POCKET LIGHTER

(76) Inventor: Guang Lin, 109 Kings Mountain Dr., Greer, SC (US) 29650

Reexamination Request:
No. 90/006,432, Nov. 1, 2002

Reexamination Certificate for:
Patent No.: 6,267,582
Issued: Jul. 31, 2001
Appl. No.: 09/439,523
Filed: Nov. 12, 1999

(51) Int. Cl.
*F23D 11/36* (2006.01)

(52) U.S. Cl. ..... 431/153; 431/255
(58) Field of Classification Search ..... 431/128, 431/153, 255, 275, 132; 310/339; 317/81, 317/DIG. 11; 361/260
See application file for complete search history.

(56) References Cited

U.S. PATENT DOCUMENTS

| | | | | | |
|---|---|---|---|---|---|
| 3,734,680 | A | | 5/1973 | Maruyama | 431/255 |
| 3,829,737 | A | * | 8/1974 | Johnsson | 431/255 |
| 3,961,876 | A | * | 6/1976 | Chernock | 431/344 |
| 4,030,221 | A | * | 6/1977 | Doobenen et al. | 42/70.07 |
| 4,139,792 | A | * | 2/1979 | Kondo | 310/339 |
| 4,786,248 | A | | 11/1988 | Nitta | 431/255 |
| 4,850,854 | A | * | 7/1989 | Buck | 431/255 |
| 4,921,420 | A | * | 5/1990 | Johnston | 431/153 |
| 5,224,854 | A | * | 7/1993 | Ansquer | 431/153 |
| 5,228,849 | A | | 7/1993 | Frigiere | 431/255 |
| 5,558,514 | A | | 9/1996 | Ansquer | 431/153 |
| 5,662,466 | A | * | 9/1997 | Cheng | 431/153 |
| 5,854,530 | A | * | 12/1998 | LaForest et al. | 310/339 |
| 5,971,751 | A | * | 10/1999 | Lee | 431/255 |
| 6,533,576 | B1 | | 3/2003 | Sher | 431/255 |

FOREIGN PATENT DOCUMENTS

CN 2332915 Y 8/1999

OTHER PUBLICATIONS

U.S. Consumer Product Safety Commission, "CPSC Initiates Rulemaking for Cigarette Lighters"; Jan. 7, 1988; Release #88–001.*
16 CFR 1210 Safety Standards for Cigarette Lighters, Jul. 12, 1993.*
Imrhan et al., "Trends in Finger Pinch Strength in Children, Adults, and the Elderly"; Dec. 1989; Human Factors 31(6), pp. 689–701.*
U.S. Consumer Product Safety Commission; "Force Measurements of a Child Resistant Cigarette Lighter";Mar. 13, 1992.*

* cited by examiner

*Primary Examiner*—Aaron J. Lewis

(57) ABSTRACT

A pocket lighter of the present invention comprises a gas container having an outlet valve through which ignitable gas is released. An igniter device having a reciprocative plunger is also provided. The igniter device is operative to produce a spark when the plunger is axially moved. A thumb actuator is operative to cause opening of the outlet valve and axial movement of the reciprocative plunger, thereby producing a controlled flame. The pocket lighter is constructed and arranged such that at least ten pounds of force is required to operate the thumb actuator.

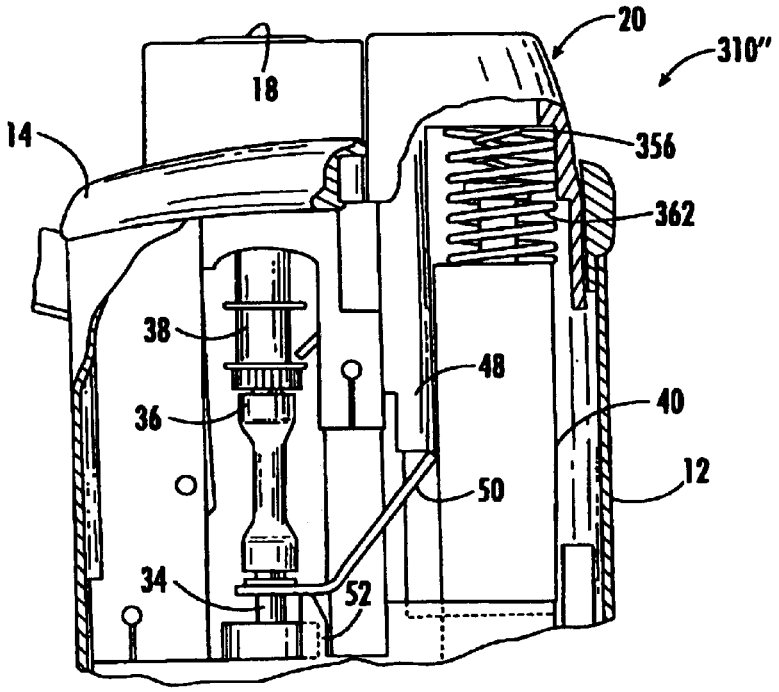

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *